US006536257B2

(12) United States Patent
Nishigori et al.

(10) Patent No.: US 6,536,257 B2
(45) Date of Patent: Mar. 25, 2003

(54) SPEED-CHANGING GEAR MANUFACTURING APPARATUS

(75) Inventors: Sakae Nishigori, Yasu-gun (JP); Tadashi Okumura, Koga-gun (JP)

(73) Assignee: Gohsyu Corporation, Shiga Pref. (JP)

( * ) Notice: Subject to any disclaimer, the term of this patent is extended or adjusted under 35 U.S.C. 154(b) by 0 days.

(21) Appl. No.: 09/837,295

(22) Filed: Apr. 19, 2001

(65) Prior Publication Data

US 2001/0032487 A1 Oct. 25, 2001

(30) Foreign Application Priority Data

Apr. 21, 2000 (JP) ..... 2000-120720
Feb. 14, 2001 (JP) ..... 2001-036693

(51) Int. Cl.[7] ..... B21K 1/30
(52) U.S. Cl. ..... 72/354.2; 29/893.34
(58) Field of Search ..... 72/354.2; 29/893.34

(56) References Cited

U.S. PATENT DOCUMENTS 3,688,549 A * 9/1972 Ohnishi et al. ..... 29/893.34

FOREIGN PATENT DOCUMENTS

JP 4-200836 * 7/1992 ..... 72/354.2

* cited by examiner

*Primary Examiner*—Lowell A. Larson
(74) *Attorney, Agent, or Firm*—Wenderoth, Lind & Ponack, L.L.P.

(57) ABSTRACT

For the purpose of providing a speed-changing gear manufacturing apparatus capable of forming back-tapered spline teeth having a chamfer at the tip with high accuracy, by forming both side faces of spline teeth in back-tapered shape and forming the tip in chamfered shape at a time, the present invention is a speed-changing gear manufacturing apparatus comprising dies formed at regular intervals on a circumference, to enable to move a plural number of spline teeth forming units for forming back-tapered spline teeth on lines extending radially from the center axis of the gear material, and a pressing member for moving the spline teeth forming units toward the center axis of the gear material, by pressing the outer circumferential face of the spline teeth forming units of the dies, wherein said spline teeth forming units are constructed in a way to form an open space in which to form both side faces of spline teeth in back-tapered shape and form the tip in chamfered shape at a time, in contact with the adjacent spline teeth forming units and between two adjacent spline teeth forming units, by moving the spline teeth forming units toward the center axis of the gear material.

7 Claims, 11 Drawing Sheets

SPEED-CHANGING GEAR MANUFACTURING APPARATUS

BACKGROUND OF THE INVENTION

The present invention relates to a speed-changing gear manufacturing apparatus, more specifically a speed-changing gear manufacturing apparatus for forming back tapered spline teeth on a gear material.

Conventionally, on a speed-changing gear used for manual transmission, etc. are formed spline teeth having a chamfer at the tip and having both side faces formed in the shape of back taper (hereinafter referred to as "back-tapered spline teeth" in some cases), and speed change teeth composed of spur gear or helical gear.

As apparatus for manufacturing this back-tapered spline teeth of speed-changing gear by forging only without cutting work, there is one which is disclosed in the Japanese Provisional Patent Publication No. 63-120958, for example.

This speed-changing gear manufacturing apparatus is constructed in a way to form both side faces of spline teeth in back-tapered shape by pressing, by means of a pressing member, a plural number of dies disposed at regular intervals on a circumference, so that they may move on the lines extending radially from the center axis of the gear material, between spline teeth having parallel side faces formed in advance on the gear material, and moving them toward the center axis of the gear material.

By the way, said conventional speed-changing gear manufacturing apparatus had an advantage of being capable of forming both side faces of spline teeth in back-tapered shape with high accuracy, by means of a plural number of dies disposed at regular intervals on a circumference.

However, a problem with this speed-changing gear manufacturing apparatus was that, when forming both side faces of the spline teeth in back-tapered shape, dispersion is produced in the shape of the chamfer or in the height of back-tapered spline teeth, because the chamfer formed in advance on the tip of the spline teeth is not restricted by the die or other member.

SUMMARY OF THE INVENTION

In view of the problems inherent with said conventional speed-changing gear manufacturing apparatus, the objective of the present invention is to provide a speed-changing gear manufacturing apparatus capable of forming back-tapered spline teeth having a chamfer at the tip with high accuracy, by forming both side faces of spline teeth in a back-tapered shape and forming the tip in a chamfered shape at the same time.

To achieve said objective, the speed-changing gear manufacturing apparatus according to the present invention is a speed-changing gear manufacturing apparatus comprising dies formed at regular intervals on a circumference, to enable it to move a plural number of spline teeth forming units for forming back-tapered spline teeth on the lines extending radially from the center axis of the gear material, and a pressing member for moving the spline teeth forming units toward the center axis of the gear material, by pressing the outer circumferential face of the spline teeth forming units of the dies, characterized in that said spline teeth forming units are constructed in a way to form an open space in which to form both side faces of spline teeth in a back-tapered shape and form the tip in a chamfered shape at the same time, in contact with the adjacent spline teeth forming units and between two adjacent spline teeth forming units, by moving the spline teeth forming units toward the center axis of the gear material.

This speed-changing gear manufacturing apparatus, constructed in a way to form an open space in which to form both side faces of spline teeth in a back-tapered shape and form the tip in a chamfered shape at the same time, in contact with the adjacent spline teeth forming units and between two adjacent spline teeth forming units, by moving the spline teeth forming units of the dies toward the center axis of the gear material, is capable of forming both side faces of spline teeth in a back-tapered shape and forming the tip in a chamfered shape at the same time, and capable of forming back-tapered spline teeth having a chamfer at the tip with high accuracy.

And, the speed-changing gear manufactured in this way, which is uniform in chamfer shape and height of the back-tapered spline teeth, enables a smooth speed-changing motion using a manual transmission, etc. when required.

In this case, said dies may be constructed in such a way to have an arced shell in which are formed slits at regular intervals in a longitudinal direction up nearly to the bottom part, form spline teeth forming units at the top end of the respective shells split by said slits, and support the bottom face of the spline teeth forming units of the dies with die holders formed on the sloped face rising toward the center axis of the gear material.

This will enable the spline teeth forming units of the dies to automatically return, after forming back-tapered spline teeth having a chamfer at the tip, with a restorative force of the shell formed in an arced shape.

Moreover, this enables the simplification of the manufacturing apparatus structure, facilitates maintenance work, and reduces the manufacturing and maintenance costs of the manufacturing apparatus.

Furthermore, this makes it possible, when moving the spline teeth forming units toward the center axis of the gear material, by pressing the outer circumferential face of the spline teeth forming units of the dies by means of a pressing member, to prevent the spline teeth forming units from turning around the bottom part of the dies, thus enabling it to form back-tapered spline teeth having a chamfer at the tip with higher accuracy.

Additionally, it becomes possible to reduce the radial direction force applied to the shells formed with the arced shape of the dies through the spline teeth forming units.

In this case, said dies may be constructed in such a way to be split into the same number as the number of spline teeth to be formed, and to form spline teeth forming units at the top end, the split dies being disposed in an annular shape, and fastened at the bottom end by means of a fastening fixture.

This makes it possible to easily manufacture dies provided with spline teeth forming units.

Yet more, this enables, even in cases with any wear or damage to the spline teeth forming units, to replace the dies only in the part concerned, thus facilitating maintenance and reducing the cost of the manufacturing apparatus.

In addition, said dies may be constructed with die elements, split in the same number as the number of spline teeth to be formed and forming spline teeth forming units at the top end, and die element holders disposed and held in an annular shape to enable the die elements to move on a line extending radially from the center axis of the gear material.

This makes it possible to easily manufacture dies provided with spline teeth forming units.

Moreover, this enables, even in cases with any wear or damage to the spline teeth forming units, the replacement of dies only in the part concerned, thus facilitating maintenance and reducing the cost of the manufacturing apparatus.

And, it is possible to form a sliding piece on the inner circumferential side of each die element, and slidably support it with a die element pressing device fixed to the material receiving base.

This makes it possible to slide the split die elements with good accuracy, and form highly accurate spline teeth.

Furthermore, it is possible to dispose, at the center of the die element holder, a die element returning ring forming a sloped face at the outer circumferential edge, to make the respective die elements return in an upward motion after the forming of the spline teeth.

This enables the accurate removal of gear material after forming from among the dies with a simple device.

DETAILED DESCRIPTION OF THE INVENTION

Figure 1:
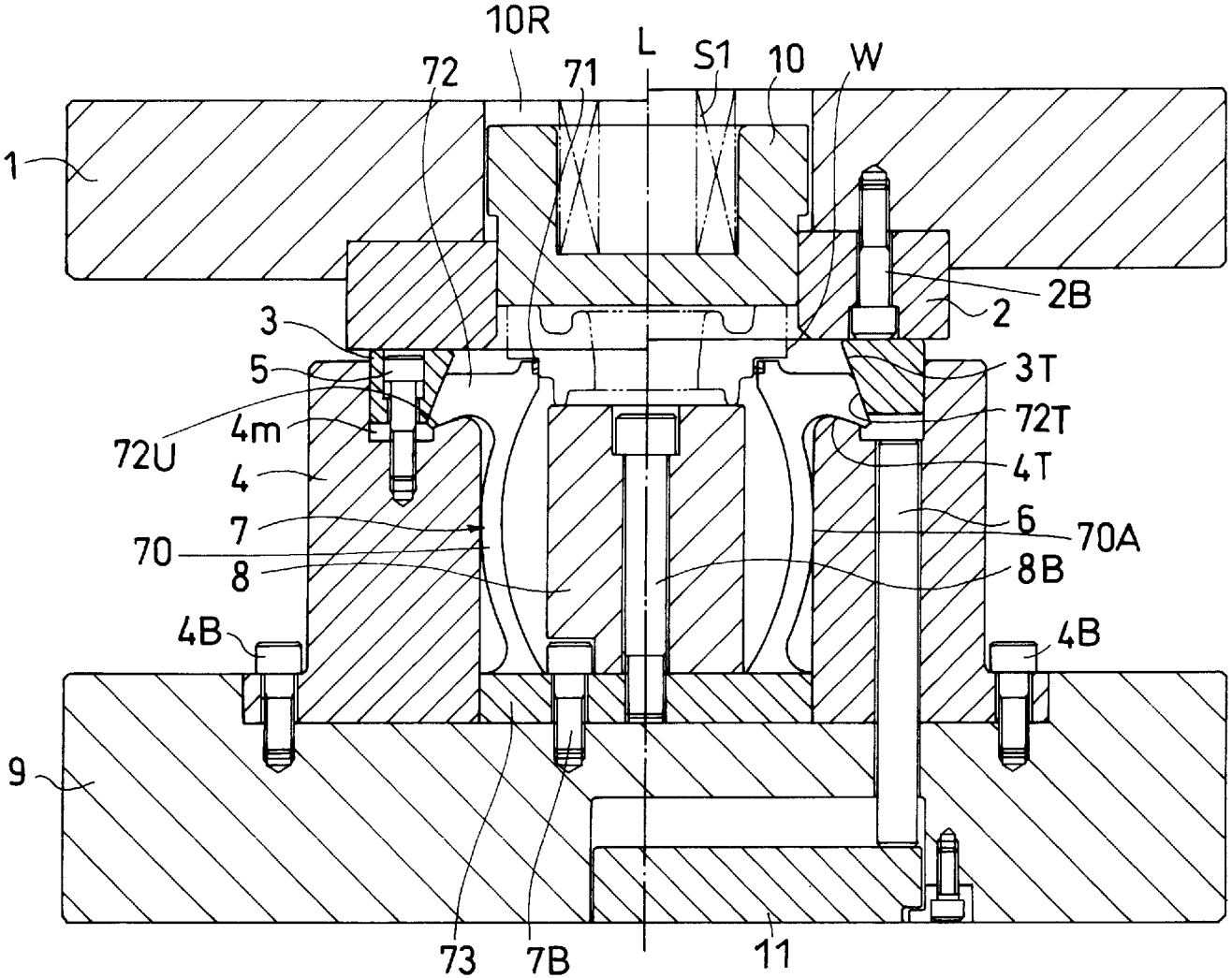
FIG. 1 is a sectional view showing the first embodiment of the speed-changing gear manufacturing apparatus according to the present invention.
Figure 2:
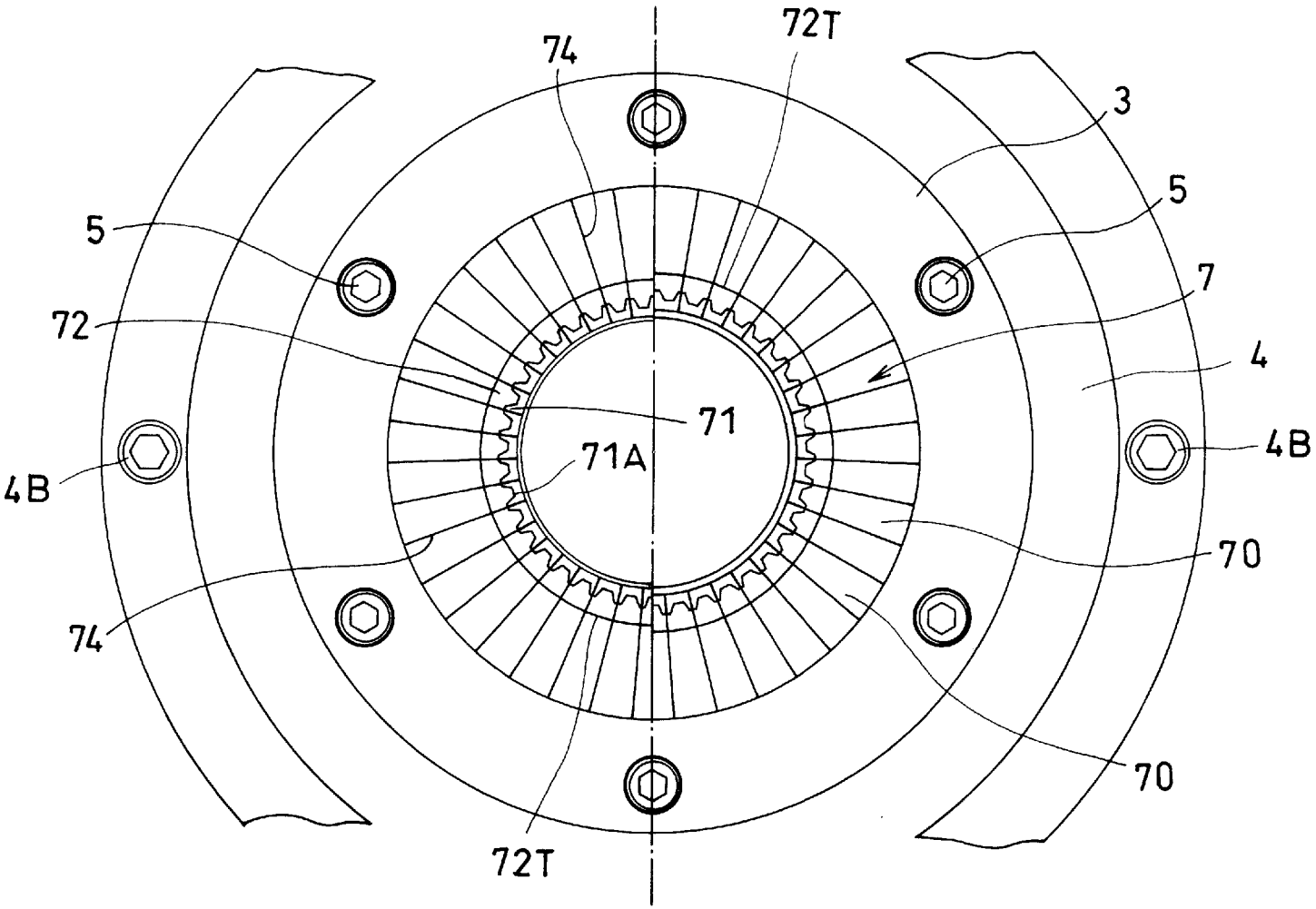
FIG. 2 is a plan view for above.

Explanation will be given hereafter on an embodiment of the speed-changing gear manufacturing apparatus according to the present invention, based on drawings.

FIG. 1 to FIG. 4 indicate the first embodiment of the speed-changing gear manufacturing apparatus according to the present invention.

This speed-changing gear manufacturing apparatus is constructed, in its main part, with die 7 formed at regular intervals on a circumference, to enable a plural number of spline teeth forming units 72, installed between an upper plate 1 and a lower plate 9 which make up-down motions with a motion of a forging press and intended for forming back-tapered spline teeth G on the gear material W, to move on the lines extending radially from the center shaft L of the gear material W (same as the center axis L of the speed-changing gear manufacturing apparatus including die 7, referred to as "center axis L of the gear material W" in the present specification), a pressing member 3 for moving the spline teeth forming units 72 toward the center axis L of the gear material W, by pressing the outer circumferential face 72T of the spline teeth forming units 72 of the die 7, and die holder 4 supporting the bottom face 72U of the spline teeth forming units 72 of the die 7.

And, to the bottom face of the upper plate 1 is fixed a punch 2 formed in cylindrical shape by means of bolt 2B, and in the open space 10R formed at the center of the upper plate 1 and the punch 2 is disposed an upper die 10 in a way to be movable by prescribed distance in the up-down direction, against the urging force of a spring S1, while being protected against falling by the punch 2.

Below the punch 2 is provided a pressing member 3, to be pressed and pushed downward as the punch 2 is put down.

This pressing member 3 is disposed at the position of a ring-shaped groove 4*m* formed on the top face of the die holder 4 formed in cylindrical shape, in a way to be movable by prescribed distance in the up-down direction, while being protected against falling by bolt 5.

The punch 2 and the pressing member 3 may be integrally formed.

And, through the inside of the die holder 4 are disposed a plurality of knock-out pins 6 for pushing the pressing member 3 upward to make it return to its original position, when the pressing force of the punch 2 is cancelled, and it is so arranged that the knock-out pins 6 may be pushed upward by a push-up member 11 for knock-out pins 6 disposed in a way to move up and down in the lower plate 9.

Figure 5:
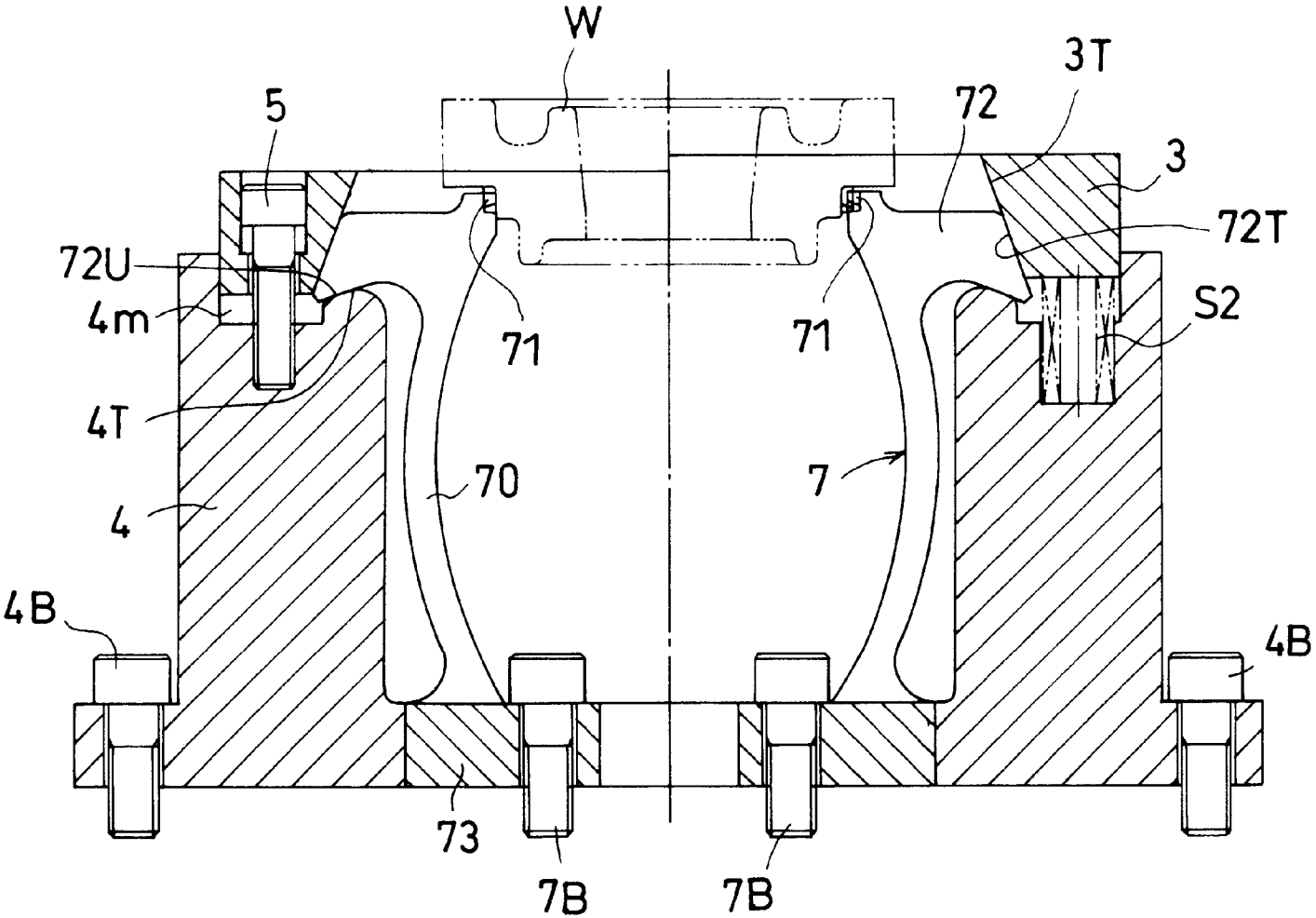
FIG. 5 is a sectional view showing the second embodiment by modification of an embodiment of the speed-changing gear manufacturing apparatus according to the present invention.

By the way, the mechanism for pushing the pressing member 3 upward to make it return to its original position, when the pressing force of the punch 2 is cancelled, is not restricted to that of this embodiment, but may also be constructed by disposing the pressing member 3 in a way to be movable by prescribed distance in the up-down direction, against the urging force of a spring S2 and push the pressing member 3 upward to make it return to its original position, when the pressing force of the punch 2 is cancelled, as shown in a modified example of this embodiment indicated in FIG. 5, for example.

Other constructions and actions of this modified example are the same as those of the embodiment indicated in FIG. 1 to FIG. 4.

The inner circumferential face 3T of the pressing member 3 is formed on a sloped surface inclined downward.

The angle of inclination of this inner circumferential face 3T is set in such a way that, when the pressing member 3 is pushed down through the punch 2, the inner circumferential face 3T gets in contact with the outer circumferential face 72T formed in upward slope of the spline teeth forming units 72 of the die 7, to enable the spline teeth forming units 72 to move by prescribed distance to ward the center axis L of the gear material W.

The die holder 4 is fixed to the lower plate 9 by means of bolt 4B.

This die holder 4 is formed in cylindrical shape, disposes the die 7 in the inner open space, and is constructed in a way to slidably support the bottom face 72U of the spline teeth forming units 72 of the die 7 with the die holder 4.

This makes it possible, when moving the spline teeth forming units 72 toward the center axis L of the gear material W, by pressing the outer circumferential face 72T of the spline teeth forming units 72 of the die 7, with the inner circumferential face 3T of the pressing member 3, to reduce the force in axial direction applied to the shells 70 formed in arcked shape of the die 7 through the spline teeth forming units 72, thus improving the durability of the die 7.

Moreover, it is desirable to form the contact surface 4T of the die holder 4 to be in contact with the bottom face 72U of the spline teeth forming units 72 of the die 7 on a sloped face rising toward the center axis L of the gear material W.

This will make it possible, when moving the spline teeth forming units 72 toward the center axis L of the gear material W, by pressing the outer circumferential face 72T of the spline teeth forming units 72 of the die 7, with the inner circumferential face 3T of the pressing member 3, to prevent the spline teeth forming units 72 from turning around the bottom part 73 of the die 7, thus enabling to form back-tapered spline teeth G having a chamfer C at the tip with high accuracy.

The bottom face 72U of the spline teeth forming units 72 and the contact surface 4T of the die holder 4 to be in contact with this bottom face 72U may be formed on a sloped face in plane, and also on a slightly curved sloped face.

The die 7 is fixed, at the bottom 73 formed in the shape of a disc, to the lower plate 9, with bolt 4B.

This die 7 is constructed in a way to have an arcked shell 70 in which are formed slits 74 at regular intervals in longitudinal direction up to near the bottom part 73, and form spline teeth forming units 72 at the top end of the respective shells 70 split by said slits 74.

This enables the spline teeth forming units 72 of the die 7, after forming back-tapered spline teeth G having a chamfer C at the tip, on the gear material W, to automatically return, with a restorative force of the shell 70 formed in arcked shape.

In this case, by forming the die holder 4 and the die 7 in such a way that, when the spline teeth forming units 72 of the die 7 are moved toward the center axis L of the gear material W, by pressing the outer circumferential face 72T of the spline teeth forming unit 72 of the die 7, the largest-diameter portion 70A of the shell 70 of the die 7 gets in contact with the inner circumferential face of the die holder 4, it becomes possible to increase the restorative force of the shell 70 formed in arcked shape.

Figure 3:
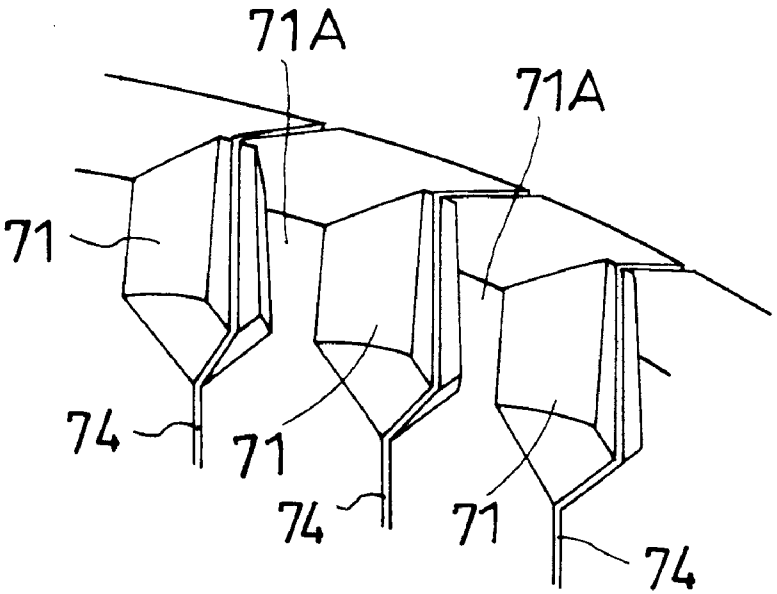
FIG. 3 indicates the spline teeth forming units of the die, (A) showing a state in which spline teeth forming units are in contact with one another, and (B) a separated state.
Figure 3:
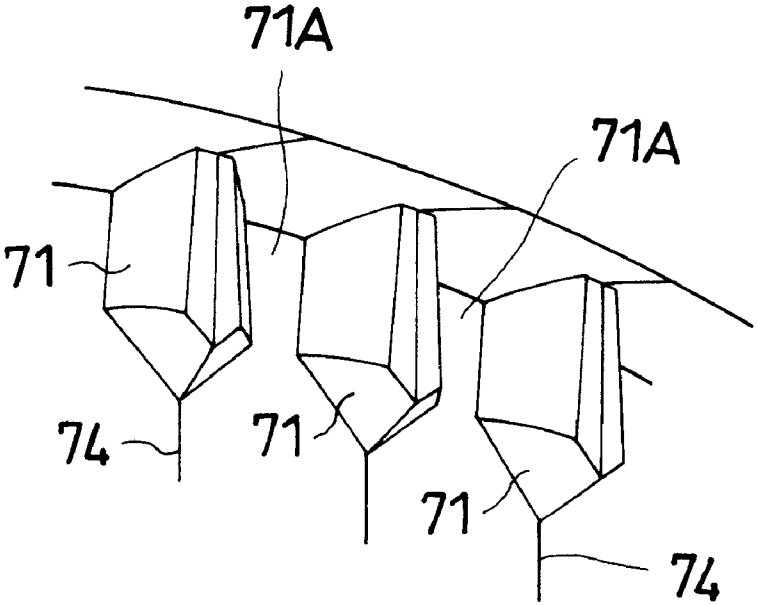
Figure 4:
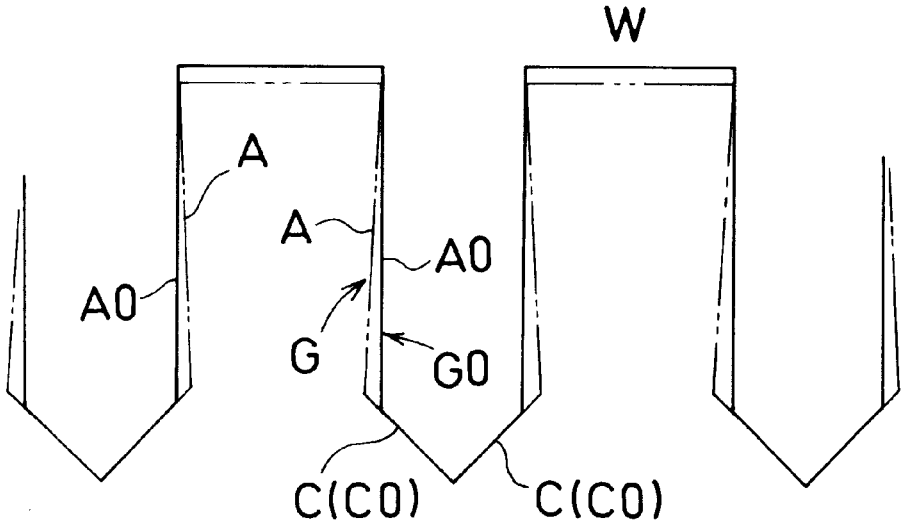
FIG. 4 is an explanatory drawing of spline teeth, (A) showing the states before and after the forming, and (B) a modified example of back-tapered spline teeth.
Figure 4:
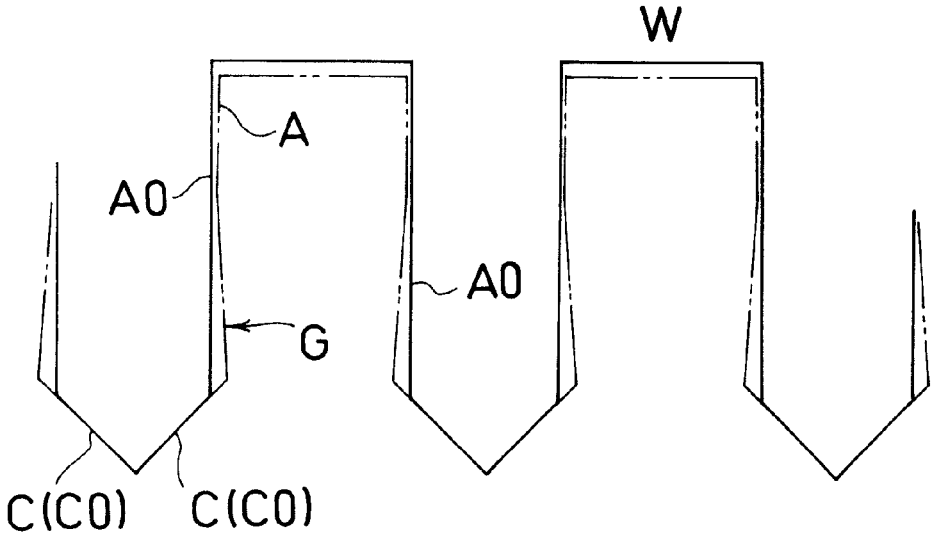

Furthermore, at the tip of the spline teeth forming unit 72 of the die 7 is formed, as shown in FIG. 3, a space 71 in concave shape for forming, between two adjacent spline teeth forming units 72, 72, both side faces A0, A0 of the spline teeth G0 having parallel side faces A0, A0 formed in advance on the gear material W in the shape of back-tapers A, A, as shown in FIG. 4(A), and further forming the tip in the shape of high-accuracy chamfers C, C (in this case, the tip of the spline teeth G0 of the gear material W shall preferably be formed in advance roughly in the shape of the chamfers C0, C0) at a time respectively, by moving the spline teeth forming unit 72 toward the center axis L of the gear material W to make it get in contact with the adjacent spline teeth forming unit 72, while restricting the circumferential face of the spline teeth G0.

For that reason, this space 71 is provided in a way to construct the shape at the tip of the spline teeth forming unit 72 of the die 7, with the concave part formed on both sides of a convex part 71A.

The spline teeth forming unit 72 of the die 7 may be constructed to be formed in the shape of back-tapers A, A over about the entire length on both side faces of the spline teeth G, as shown in FIG. 4(A), or may be further constructed to be formed in the shape of back-tapers A, A up to about the middle position on both side faces of the spline teeth G, as shown in FIG. 4(B).

In the die 7 is disposed a material receiving base 8 supporting the gear material W, and fixed to the bottom part 73 of the die 7, by means of bolt 8B.

Next, explanation will be given on the actions of this speed-changing gear manufacturing apparatus.

In the first place, steel products usable as gear, or bar steel products such as SC steel, SCM steel, SNC steel, SNCM steel, SCR steel, etc., for example, are cut to a volume fit for the size of speed-changing gears to be manufactured, and this cut material is heated to a temperature suitable for plastic working of the material, and then submitted to a plurality of processes such as roughing process, finishing process, cold coiling process, etc. to obtain gear material W provided with spline teeth G0 having parallel side faces A0, A0 with a tip formed in about the shape of chamfers C0, C0.

The gear material W formed this way is placed on the material receiving base 8 of this speed-changing gear manufacturing apparatus.

In this case, the gear material W will be placed in such a way that the spline teeth G0 formed on its circumferential surface about agrees with the space 71 in concave shape formed at the tip of the spline teeth forming unit 72 of the die 7.

And, the forging press is operated, to make the upper plate 1 come down, after mounting the punch 2 and the upper die 10 on it.

As a result of this operation, the gear material W is pinched between the material receiving base 8 and the upper die 10 urged by the spring S1.

And, the upper plate 1 is further lowered, to push down the pressing member 3 through the punch 2 mounted on the upper plate 1, and press the outer circumferential face 72T of the die 7, with the inner circumferential face 3T of the pressing member 3, to make the spline teeth forming unit 72 move by prescribed distance toward the center axis L of the gear material W.

This makes it possible to make adjacent spline teeth forming units 72 get in contact with each other and form, between two adjacent spline teeth forming units 72, 72, both side faces A0, A0 of the spline teeth G0 having parallel side faces A0, A0 formed in advance on the gear material W in the shape of back-tapers A, A, and further form the tip in the shape of high-accuracy chamfers C, C at a time respectively, while restricting the circumferential face of the spline teeth G.

After forming, in this way, spline teeth G in the shape of back-tapers having chamfer C at the tip, the forging press is operated in the opposite direction, to make the upper plate 1 on which are mounted the punch 2 and the upper die 10 go up.

As a result of this operation, the gear material W cancels the pinching of gear material W between the material receiving base 8 and the upper die 10 urged by the spring S1 and, at the same time, releases the pressing of the pressing member 3 which has been pushed down through the punch 2, and, with an action of the knock-out pin 6 (or spring S2), pushes the pressing member 3 upward to make it return to its initial position.

Still more, as the pressing member 3 returns to its initial position, the restorative force of the shell 70 formed in the shape of an arch works, to cancel the engagement between the spline teeth forming unit 72 of the die 7 and the back-tapered spline teeth G having a chamfer C at the tip of the gear material W, thus enabling the spline teeth forming unit 72 of the die 7 to automatically return to its initial position.

And, the gear material W the forming of which has been completed is taken out, to complete the process of forming back-tapered spline teeth G having a chamfer C at the tip of the gear material W.

The gear material W is later submitted to a plurality of processes such as shaft hole finishing process, forming process of speed-changing gear consisting of spur gear or helical gear, etc. into finished products.

This speed-changing gear manufacturing apparatus is capable of forming both side faces A0, A0 of the spline teeth G0 in the shape of back-tapers A, A, and further forming the tip in the shape of high-accuracy chamfers C, C at a time respectively, while restricting the circumferential face of the spline teeth G0.

And, the speed-changing gear manufactured this way enables, when used for manual transmission, etc. smooth execution of its speed-changing action, because of uniform chamfer C shape and uniform height of back-tapered spline teeth G.

Figure 6:
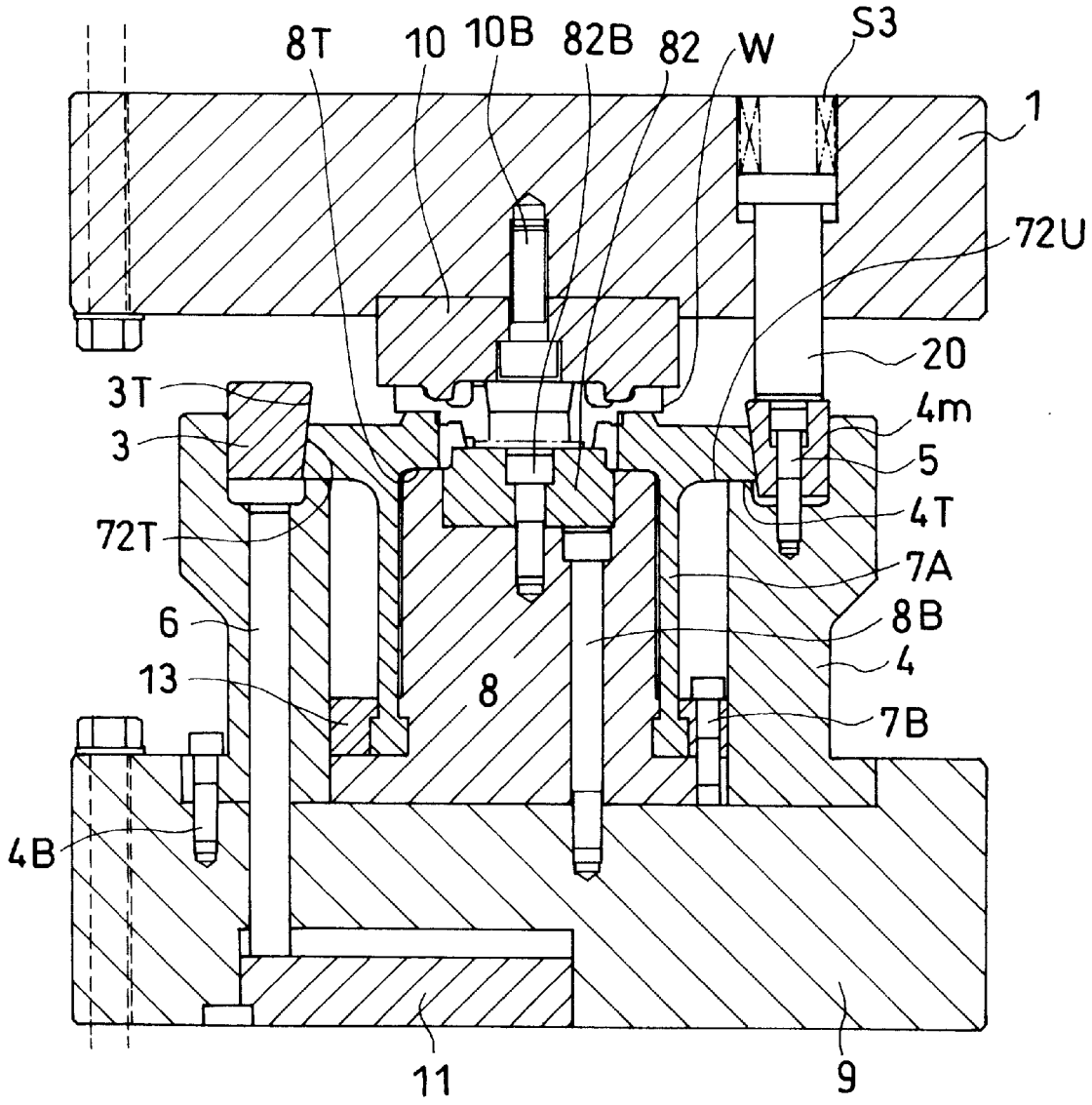
FIG. 6 is a sectional view showing the second embodiment of the speed-changing gear manufacturing apparatus according to the present invention.
Figure 7:
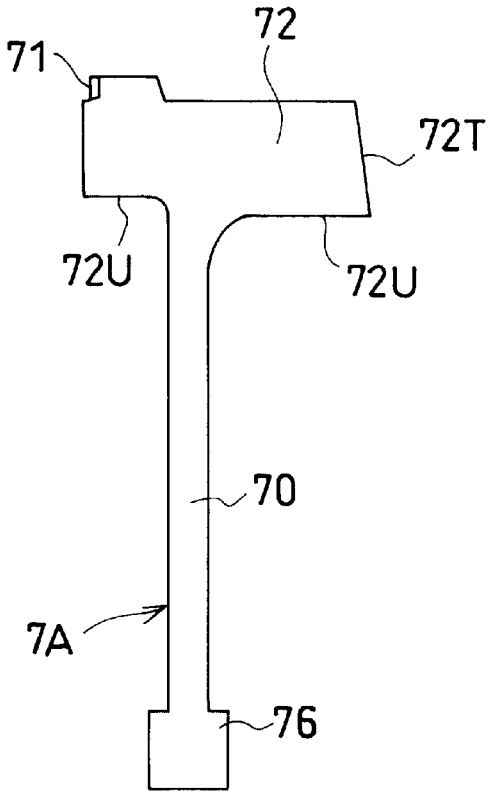
FIG. 7 indicates a die, (A) being a front elevation, and (B) a side view.
Figure 7:
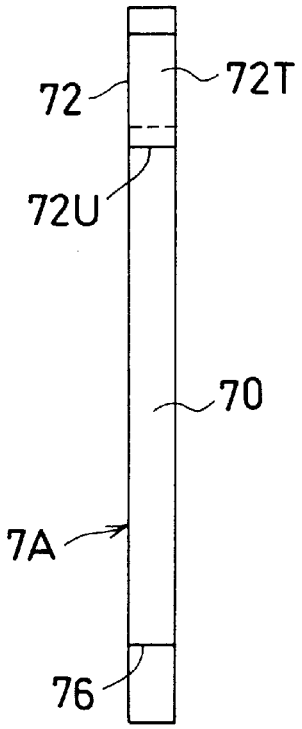

FIG. 6 to FIG. 7 indicate the second embodiment of the speed-changing gear manufacturing apparatus according to the present invention.

This speed-changing gear manufacturing apparatus is constructed, by using a die 7A, split into the same number as the number of spline teeth to be formed and forming spline teeth forming units 72 at its tip, in place of the integrally formed die 7 in said first embodiment, disposing this split die 7A in annular shape between the holder 4 and the material receiving base 8, and fixing it at the bottom end by means of a clamping fixture 13.

Moreover, in the speed-changing gear manufacturing apparatus of this embodiment, to the bottom face of the upper plate 1 is fixed an upper die 10 through bolt 10B, and disposed a punch 20 in a way to be movable by prescribed distance in the up-down direction, against the urging force of a spring S3.

Below the punch 20 is provided a pressing member 3, to be pushed downward as the punch 20 is put down.

This pressing member 3 is disposed at the position of a ring-shaped groove 4*m* formed on the top face of the die holder 4 formed in cylindrical shape, in a way to be movable by prescribed distance in the up-down direction, while being protected against falling by bolt 5.

And, through the inside of the die holder 4 are disposed a plurality of knock-out pins 6 for pushing the pressing member 3 upward to make it return to its original position, when the pressing force of the punch 20 is cancelled, and it is so arranged that the knock-out pins 6 may be pushed upward by a push-up member 11 for knock-out pins 6 disposed in a way to move up and down in the lower plate 9.

The inner circumferential face 3T of the pressing member 3 is formed on a sloped surface inclined downward, in the same way as in said embodiment 1.

The angle of inclination of this inner circumferential face 3T is set in sucha way that, when the pressing member 3 is pushed down through the punch 20, the inner circumferential face 3T gets in contact with the outer circumferential face 72T formed in upward slope of the spline teeth forming units 72 of the die 7A, to enable the spline teeth forming units 72 to move by prescribed distance toward the center axis L of the gear material W.

The die holder 4 is fixed to the lower plate 9 by means of bolt 4B.

This die holder 4 is formed in cylindrical shape, provided with the die 7A in the inner open space, and is constructed in a way to slidably support the bottom face 72U of the spline teeth forming units 72 of the die 7A with the contact surface 4T of the die holder 4 and the top face 8T of the material receiving base 8.

This makes it possible, when moving the spline teeth forming units 72 toward the center axis L of the gear material W, by pressing the outer circumferential face 72T of the spline teeth forming units 72 of the die 7A, with the inner circumferential face 3T of the pressing member 3, to reduce the force in axial direction applied to the shells 70 formed in arcked shape of the die 7A through the spline teeth forming units 72, thus improving the durability of the die 7A and enabling to form back-tapered spline teeth G having a chamfer C at the tip with high accuracy.

The die 7A to be used will be a die 7A, split into the same number as the number of spline teeth to be formed and forming spline teeth forming units 72 at its tip, and this split die 7A will be disposed in annular shape between the holder 4 and the material receiving base 8, and fixed and integrated at the bottom end by means of a clamping fixture 13, so as to be constructed into a single annular spline teeth forming die.

This clamping fixture 13, though formed in the shape of a ring as a whole, will be split into a plural number, or into 2 or 4 parts, for example, and disposed in annular shape for use so that it may hold and fix the outer circumference at the bottom end of the die 7A.

This ring-shaped clamping fixture 13 is formed in a way to hold the mounting collar 76, formed at the bottom end of the die 7A, from the outer circumferential direction and press it from above, and fixed to the collar 81 formed at the bottom of the material receiving base 8, with bolt 7B.

Furthermore, this die 7A is formed by protruding a spline teeth forming unit 72 with a T-shaped section from the tip of an about linear-shaped shell 70, integrally forming a mounting collar 76 at the bottom end.

The shape of the tip face of the spline teeth forming unit 72 is formed and constructed in the same way as in the first embodiment.

To assemble this die 7A by disposing it in an annular shape, the die 7A is loaded on the collar 81 of the material receiving base 8, and a plurality of dies 7A are disposed in the shape of a ring along the outer circumferential face of the material receiving base 8, and the mounting collar 76 of the died 7A is fastened to the collar 81 of the material receiving base 8, by bolt 7B, through the clamping fixture 13. In this case, it is so arranged that adjacent died 7A, 7A may be put as close as possible to each other according to the forming of the spline teeth G.

This makes it possible for the die 7A formed in split state to be integrated, and constructed as a single ring-shape spline teeth forming die.

And the material receiving base 8 on which is mounted the die 7A is fastened to the lower plate 9, by bolt 8B.

This makes it possible to make the spline teeth forming unit 72 of the die 7A automatically return to its initial position with the restorative force of the respective shell parts 70, after forming, on the gear material W, back-tapered spline teeth G having a chamfer C at the tip.

At the top in the central part of the material receiving base 8 is fixed an auxiliary material receiving base 82 for supporting the bottom face side of the material W with bolt 82B.

Although the constructions and actions of this embodiment are the same as those of the speed-changing gear manufacturing apparatus of said first embodiment, it becomes possible, by constructing the die 7A in split state, to easily manufacture a die 7A provided with spline teeth forming unit 72, which was difficult with integrated die 7, and perform maintenance work without difficulty because, even in case of wear or damage of the spline teeth forming unit 72, it is possible to replace the die 7A in the affected part only, thus enabling cost reduction of the manufacturing apparatus.

FIG. 8 to FIG. 11 indicate the third embodiment of the speed-changing gear manufacturing apparatus according to the present invention.

This speed-changing gear manufacturing apparatus, which is a modified example of said second embodiment, is realized by constructing the die 7B with die piece 77, split into the same number as the number of spline teeth to be formed, in the circumferential direction of the gear, and forming spline teeth forming units at its top end, and a die holder 78 for disposing and holding the split plurality of die pieces 77 in annular shape, disposing the split plurality of die pieces 77 and the die holder 78 in a way to fit in a concavity 41 of the die holder 40, and slidably holding them so that the respective die pieces 77 may move on the lines extending radially from the center axis L of the gear material W.

Moreover, in this third embodiment, to the bottom face of the upper plate 1 is fixed an upper die 10 through bolt 10B, and disposed a punch 20 in a way to be movable by prescribed distance in the up-down direction, against the urging force of a spring S3, and below this punch 20 is provided a pressing member 3, to be pushed downward as the punch 20 is put down, for moving the die pieces 77 on the lines extending radially from the center axis L of the gear material W.

This pressing member 3 is fit at the top on the inner circumferential face of the die holder 40 formed in a bedded short cylindrical shape, fastened to the die piece holder 78 by bolt 5 for protection against falling, and disposed in a way to be movable by a prescribed distance set in advance and in the up-down direction.

And, through the inside of the die holder 40 and the mounting base 90 are disposed a plurality of knock-out pins 6 for pushing the pressing member 3 upward to make it return to its initial position, when the pressing force of the punch 20 is cancelled, and it is so arranged that the knock-out pins 6 may be pushed upward by a push-up member 11 for knock-out pins 6 disposed in a way to move up and down in the mounting base 90.

The inner circumferential face 3T of the pressing member 3 is formed on a sloped surface inclined downward, in the same way as in said embodiment 1 and embodiment 2.

The angle of inclination of this inner circumferential face 3T is set in such a way that, when the pressing member 3 is pushed down through the punch 20, the inner circumferential face 3T gets in contact with the outer sloped face 77T formed in upward slope on the outer side face of the die piece 77, to enable the spline teeth forming units 77H to move by prescribed distance toward the center axis L of the gear material W.

The die holder 40 is fixed to the die holder mounting base 90 by means of bolt 4B.

Figure 8:
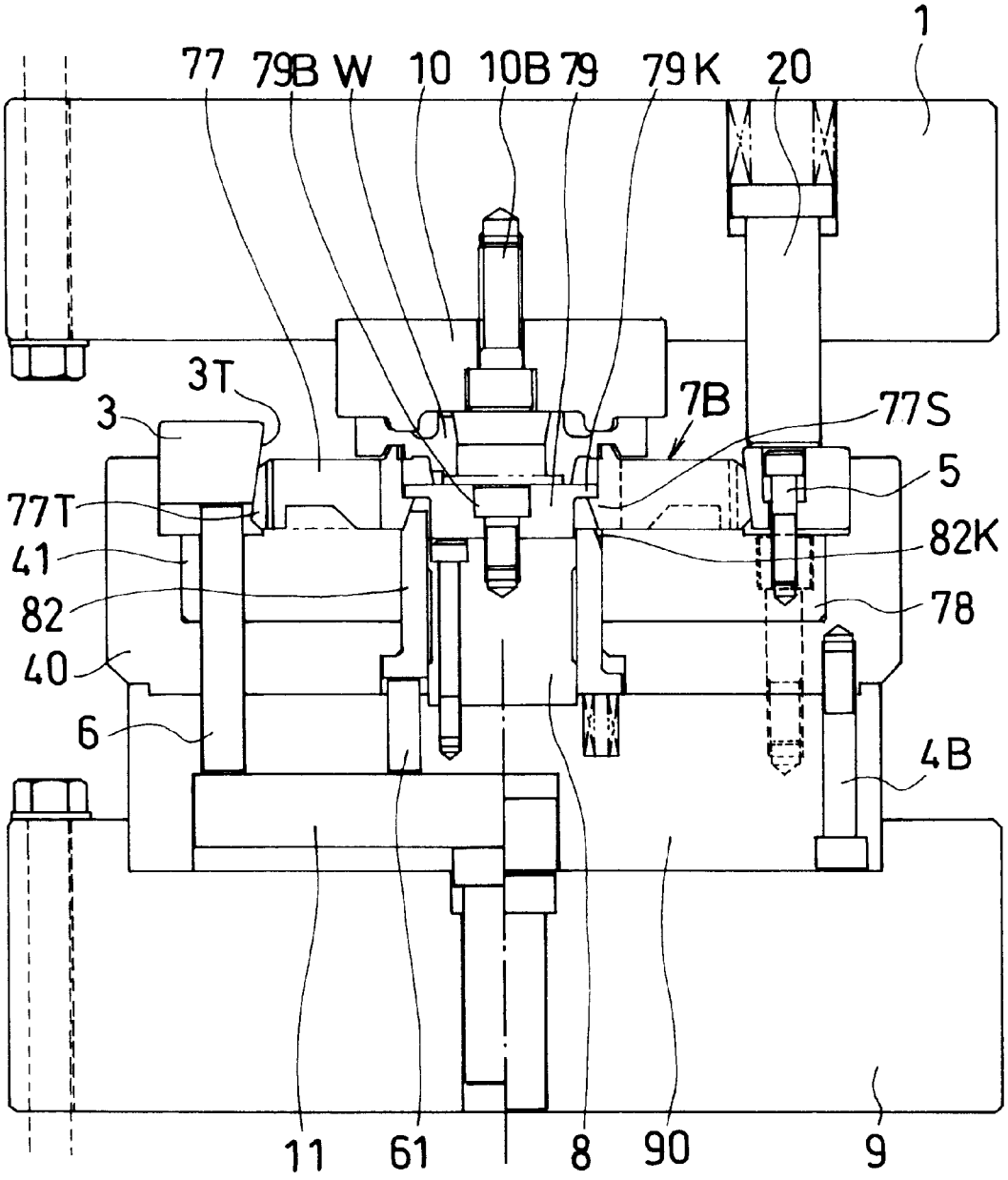
FIG. 8 is a sectional view showing the third embodiment of the speed-changing gear manufacturing apparatus according to the present invention.

The die holder 40 is formed in a bedded short cylindrical shape, disposing the split die piece 77 and the die piece holder 78, in the inner depression 41, and the material receiving base 8 and a die piece return ring 82 for returning a plurality of die pieces 77 disposed in annular shape at a time, in the central part, as shown in FIG. 8.

And, on the top face of this material receiving base 8 is disposed a die piece holding device 79 of a diameter equal to or slightly smaller than that of the die piece material receiving base 8 and fixed through a bolt 79B, to thereby support the sliding piece 77S formed on the die piece 77 in a way to prevent floating of the die 77 and be movable on the lines extending radially from the center axis L of the gear material W.

Figure 11:
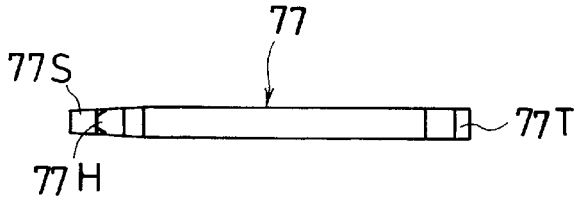
FIG. 11 indicates a die element, (A) being a front elevation, (B) a plan view, and (C) a side view.
Figure 11:
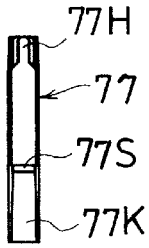
Figure 11:
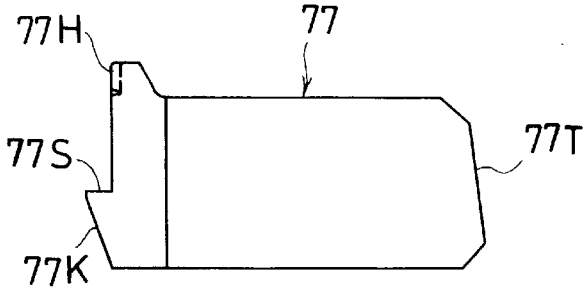

For that purpose, on the inner circumferential side of the respective die pieces 77 is formed a sliding piece 77S in about horizontal position, as shown in FIG. 11, and on the outer circumference of the die piece holding device 79 is formed a collar-shaped fastening piece 79K designed for slidably holding this sliding piece 77S.

The bottom face of this sliding piece 77S is a sloped face 77K inclined downward, and it is so arranged that, when the die piece return ring 82, whose outer circumferential face at the top end is a sloped face 82K inclined upward, goes up in a way to be pushed up by the knock-out pin 61 on this sloped face 77K, the die piece 77 sliding in the direction of center of the gear material W moves in the outer direction and spontaneously return to its initial position.

This makes it possible, when moving the spline teeth forming units 77H toward the center axis L of the gear material W, by pressing the outer circumferential face 77T of the die piece 77, with the inner circumferential face 3T of the pressing member 3, to reduce the force in radial direction applied to the die piece 77 through the spline teeth forming unit 77H, improve the durability of the die piece 77, and form back-tapered spline teeth G having a chamfer C at the tip with high accuracy.

The die piece 77 is split into the same number as the number of spline teeth to be formed, as shown in FIG. 11, and forms spline teeth forming unit 77H in prescribed shape at the top end on the tip side (inner circumferential side when housed in the die piece holder), forming in projection, under this position, a sliding piece 77S with a top face about horizontal and a bottom face which constitutes a sloped face 77K inclined downward, the side face at the other end 77T being a sloped face inclined upward.

The die will be constructed in such a way that, when this die piece 77 is incorporated in the die piece holder 78 in annular shape, it is disposed in the shape of a ring in broken line, on the lines extending radially from the center axis L of the gear material W, and that the respective die pieces 77 are movable toward the center axis L of the gear material W.

The shape of the end face at the tip of the spline teeth forming unit 77H is formed in its construction in the same way as in the first embodiment.

Figure 9:
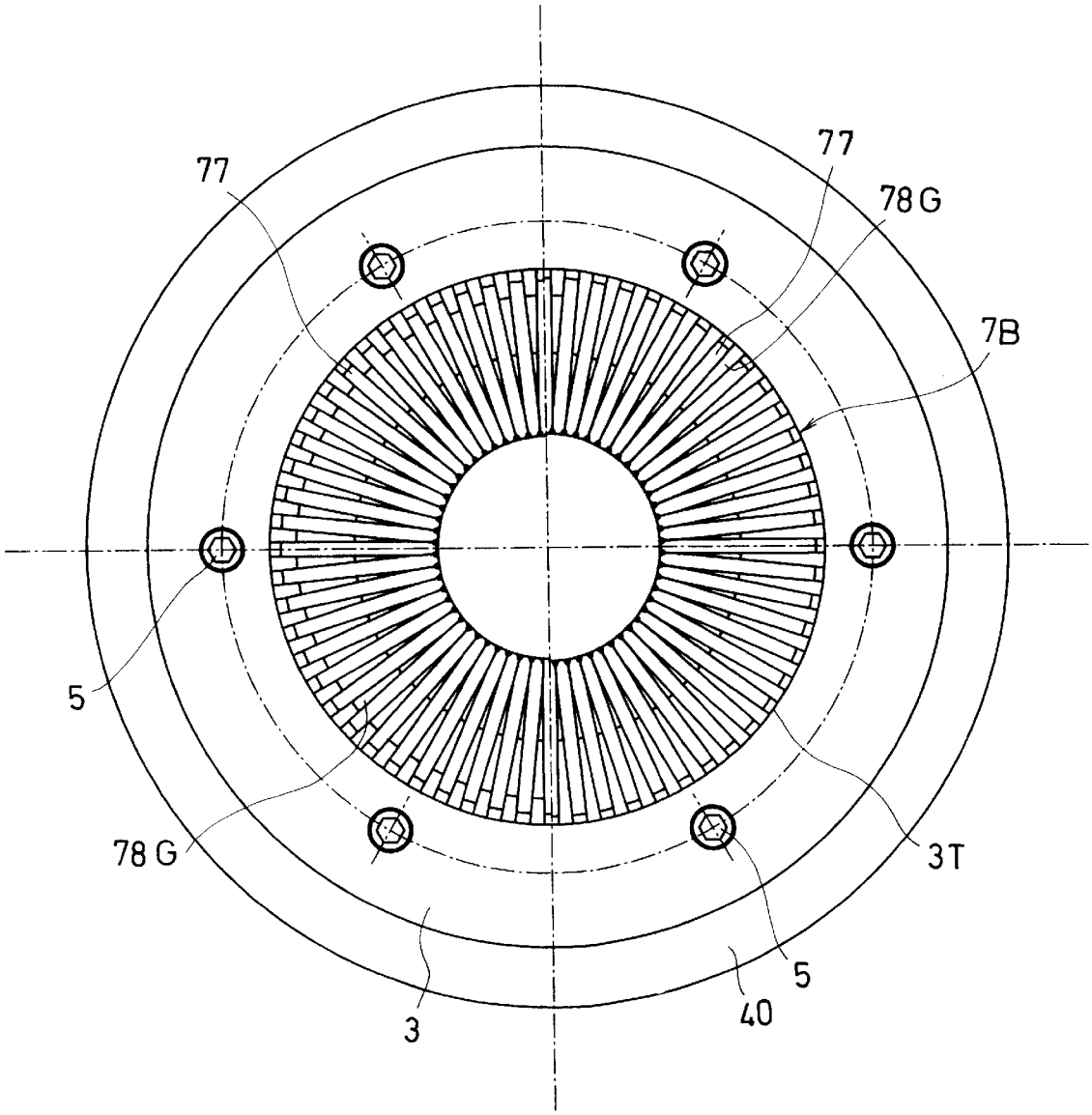
FIG. 9 is a plan view for above.
Figure 10:
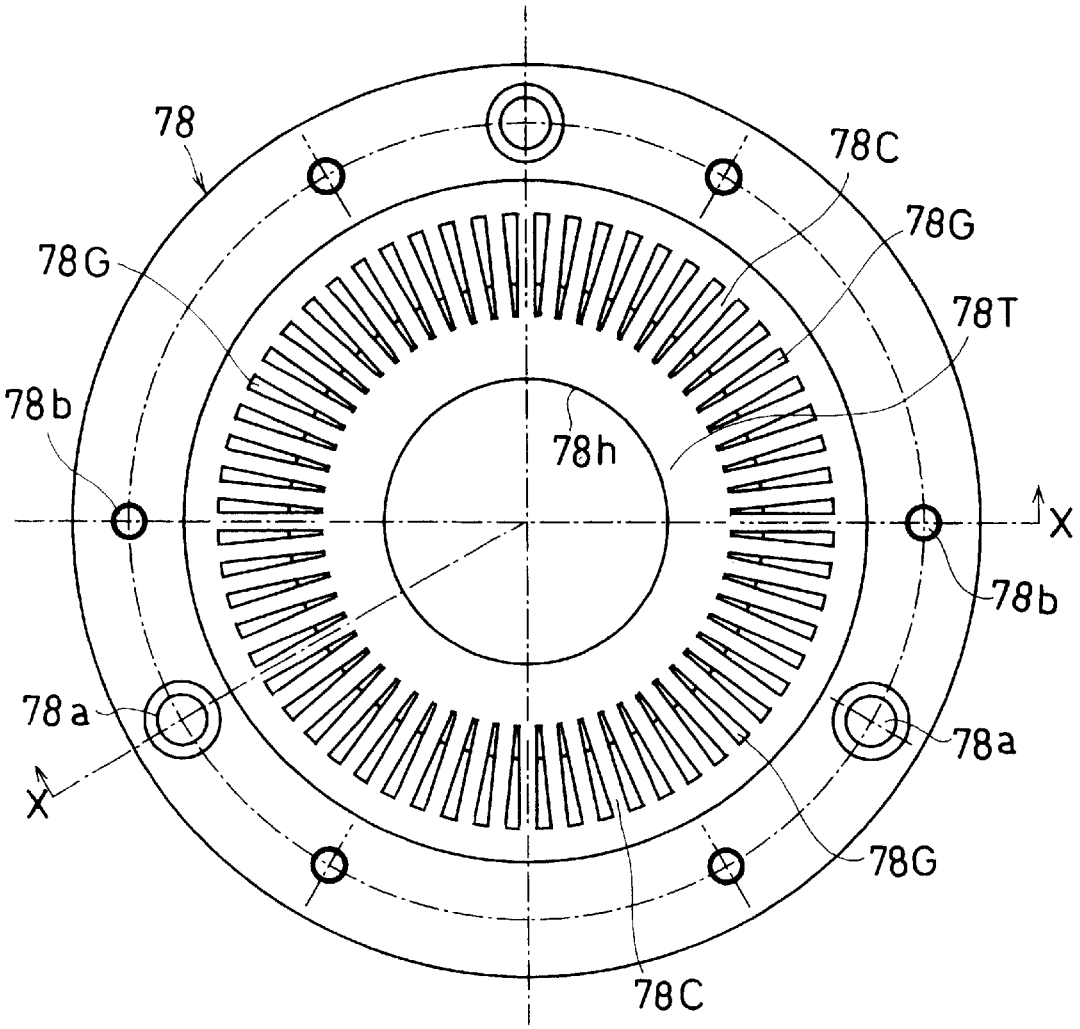
FIG. 10 indicates a die element holder, (A) being a plan view, and (B) a sectional view in line X—X.
Figure 10:
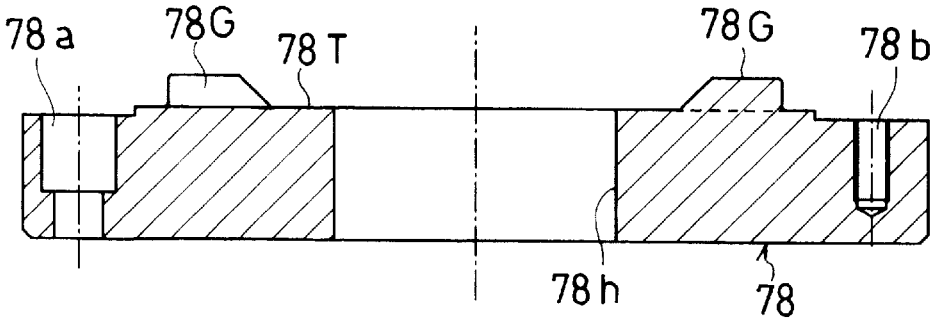

When this die piece 77 is incorporated in the shape of a ring in broken line, a die piece holder 78 as shown in FIG. 8 to FIG. 10 will be used, to ensure close contact on the side face at the tip of the spline teeth forming unit 77H, keep the interval between adjacent die pieces 77, 77 constant, and enable sliding (of the die pieces 77, 77).

This die piece holder 78 is in the shape of a disc of a size insertible in the depression 41 of the die holder 40, having a hole 78*h*, in which to fit the material receiving base 8 and the die piece return ring 82, pierced at the central part, and integrally forming, at the top face in the shape of a ring given in broken line, wedge-shaped die piece guides 78G disposed in projection at intervals of the width of the die piece 77, as shown in FIG. 8 to FIG. 9, and is constructed in a way to insert the die pieces 77 in the gap 78C between those die piece guides 78G, 78G and slidably support the respective die pieces 77 in the direction of the radially extending lines with the top face 78T of the die piece holder 78. In this case, the gap (interval) 78C of the die piece guides 78G, 78G will be formed with high accuracy to be equal to the width of the die piece 77, to thereby enable the die pieces 77 to slide in the radial direction.

On the outer circumference of this die piece holder 78 are formed bolt holes 78*b* for mounting fixing bolts of pressing member 3, and bolt holes 78*a* for bolting the die piece holder 78 to the die holder mounting base 90.

To dispose and assemble this split die piece 77 in the shape of a ring on the die piece holder 78, first the material receiving base 8 and the die piece return ring 82 are fit in the hole 78*h* of the die holder 40, and fixed to the die holder mounting base 90 through bolt 4B. In that case, on the bottom face of the die piece return ring 82 shall be interposed knock-out pin 61 and spring 82S.

This die holder mounting base 90 is placed on the lower plate 9. At that time, a knock-pin 6 is disposed in a way to pass through the die holder mounting base 90 and be supported at the bottom by the push-up member 11.

The die piece holder 78 is inserted in the depression 41 of the die holder 40, and then fixed to the die holder mounting base 90 with bolt.

On the top face of this die piece holder 78 and in the gap 78C between the die piece guides 78G, 78G are inserted, the die pieces 77 respectively, and disposed in the shape of a ring, as shown in FIG. 9.

After that, the die piece holding device 79 is fit at the central part and fixed to the material receiving base 8 with bolt 79B.

In this case, it will be so arranged that the distance between adjacent die pieces 77, 77 may be reduced as much as possible in adaptation to the forming of the spline teeth G.

This makes it possible to integrate and construct the split formed die pieces 77 into a single ring-shaped spline teeth forming die, to enable to press the sliding piece 77S of the respective die pieces 77 by means of the collar-shaped fastening piece 79K of the die piece holding device 79, prevent the die pieces 77 from floating from the top face of the die piece holder 78 even in the case where they slide in the expanding or shrinking radial direction, and form spline teeth with high accuracy.

Moreover, in the die holder 40, the pressing member 3 is fit to the outer circumference of the die piece 77 disposed in the shape of a ring by the die piece holder 78, and fixed to the die piece holder 78, with bolt 5. At that time, arrangement will be made to put the outer side face 77T of the die piece 77, disposed in the shape of a ring, in contact with the inclined inner circumferential face 3T of the pressing member 3, to thereby enable the pressing member 3, when it is pressed down through the punch 20, to push the outer side face 77T of the outer circumference of the die piece 77 with the inclined inner circumferential face 3T, move it in the shrinking radial direction and thus form prescribed spline teeth G on the outer circumference of the gear material W.

After forming with high accuracy back-tapered spline teeth G having chamber C at the tip on the gear material W with the die piece 77, it becomes possible to push up the pressing member 3, through the knock-out pin 6, and the die piece return ring 82, through the knock-out pin 61, respectively at a time, by raising the upper plate 1 and the punch 20 to cancel the pressing and, at the same time or with a slight delay, pushing up the push-up member 11. As a result, the die piece 77 is pushed out in the expanding radial direction from the center line of the gear material W, by the sloped face 82K formed in a state inclined upward on the top outer circumferential face of the die piece return ring 82, to automatically return to its initial position, and the respective die pieces 77 separate from the gear material W, the pinching force on the gear material W by the die piece is released, and the gear material W on which is formed the spline teeth can be taken out easily from the die.

Although the actions of the speed-changing gear manufacturing apparatus of this embodiment are the same as those of the speed-changing gear manufacturing apparatus of said first embodiment and second embodiment, adoption of a split construction of the die 7B as die pieces 77 enables to easily manufacture the die piece 77 provided with spline teeth forming unit 77H, which was difficult with an integrated die 7, and this also enables, even in case of any wear or damage to the spline teeth forming units 77H, to replace the die piece 77 in the affected part only, thus facilitating maintenance work and reducing the, cost of the manufacturing apparatus.

The speed-changing gear manufacturing apparatus according to the present invention has so far been explained with reference to a plurality of embodiments. However, the present invention is not restricted to the construction described in the embodiments given above, but may be changed in construction as required to the extent not deviating from its essential purpose.

What is claimed is:

1. A speed-changing gear manufacturing apparatus, comprising:

a die comprising a plurality of separate die elements located at regular intervals circumferentially of a forming position of gear material, wherein the number of said die elements corresponds to the number of spline teeth to be formed on the gear material;

said plurality of die elements having respective spline teeth forming units for forming back-tapered spline teeth on the gear material along lines extending radially from a center axis of the gear material, said spline teeth forming units having an outer circumferential face;

a die element holder for holding said die elements along the circumference of the forming position in an annular form and enabling said die elements to move along the lines extending radially from the center axis of the gear material;

a sliding surface on an inner circumferential side of each of said die elements;

a fixed die element retainer slidably engaging and retaining said sliding surface of each of said die elements; and a pressing member for moving said spline teeth forming units toward the center axis of the gear material by pressing said outer circumferential face of said spline teeth forming units of said plurality of dies;

wherein said spline teeth forming units are constructed such that open spaces are formed between adjacent spline teeth forming units, in which open spaces both side faces of spline teeth of the gear material can be formed with a back-tapered shape at the same time as the tips of the spline teeth are formed with a chamfered shape, with adjacent ones of said spline teeth forming units contacting each other, by moving said spline teeth forming units toward the center axis of the gear material.

2. The speed-changing gear manufacturing apparatus of claim 1, wherein said fixed die element retainer is fixed to a gear material receiving base.

3. The speed-changing gear manufacturing apparatus of claim 2, wherein a die element return ring is disposed at a center of said die element holder, said die element return ring having a sloped face at an outer circumferential edge thereof and being upwardly movable to engage said die elements after formation of the spline teeth on the gear material by said die elements to move said die elements away from the center axis of the gear material.

4. The speed-changing gear manufacturing apparatus of claim 3, wherein said die elements have respective sloped faces for engagement with said sloped face of said die element return ring.

5. The speed-changing gear manufacturing apparatus of claim 1, wherein a die element return ring is disposed at a center of said die element holder, said die element return ring having a sloped face at an outer circumferential edge thereof and being upwardly movable to engage said die elements after formation of the spline teeth on the gear material by said die elements to move said die elements away from the center axis of the gear material.

6. The speed-changing gear manufacturing apparatus of claim 5, wherein said die elements have respective sloped faces for engagement with said sloped face of said die element return ring.

7. A speed-changing gear manufacturing apparatus, comprising:

a die comprising a plurality of separate die elements located at regular intervals on a circumference of a forming position of gear material, wherein the number of said die elements corresponds to the number of spline teeth to be formed on the gear material;

said plurality of die elements having respective spline teeth forming units for forming back-tapered spline teeth on the gear material along lines extending radially from a center axis of the gear material, said spline teeth forming units having an outer circumferential face;

a die element holder for holding said die elements along the circumference of the forming position in an annular form and enabling said die elements to move along the lines extending radially from the center axis of the gear material;

a sliding surface on an inner circumferential side of each of said die elements;

a fixed die element retainer slidably engaging and retaining said sliding surface of each of said die elements so that said die elements are restrained in movement in an axial direction of the gear material between said fixed die element retainer and said die element holder; and a pressing member for moving said spline teeth forming units toward the center axis of the gear material by pressing said outer circumferential face of said spline teeth forming units of said plurality of dies.

* * * * *